US010520228B2

(12) United States Patent
Hu et al.

(10) Patent No.: US 10,520,228 B2
(45) Date of Patent: Dec. 31, 2019

(54) MULTI-SPLIT HVAC SYSTEM

(71) Applicant: Trane International Inc., Davidson, NC (US)

(72) Inventors: Yi Hu, Tyler, TX (US); Mark Eldo Groskreutz, Tyler, TX (US); Nicholas Shin, Tyler, TX (US)

(73) Assignee: Trane International Inc., Davidson, NC (US)

( * ) Notice: Subject to any disclaimer, the term of this patent is extended or adjusted under 35 U.S.C. 154(b) by 0 days.

(21) Appl. No.: 16/204,929

(22) Filed: Nov. 29, 2018

(65) Prior Publication Data

US 2019/0093928 A1 Mar. 28, 2019

Related U.S. Application Data

(63) Continuation of application No. 15/486,811, filed on Apr. 13, 2017, which is a continuation of application No. 14/167,955, filed on Jan. 29, 2014, now Pat. No. 9,625,184.

(60) Provisional application No. 61/759,279, filed on Jan. 31, 2013.

(51) Int. Cl.

| | |
|---|---|
| ***F24F 12/00*** | (2006.01) |
| ***F24F 13/30*** | (2006.01) |
| ***F25B 13/00*** | (2006.01) |
| ***F25B 49/02*** | (2006.01) |

(52) U.S. Cl.

CPC ..... *F25B 13/00* (2013.01); *F25B 49/022* (2013.01); *F25B 2313/0233* (2013.01); *F25B 2313/0253* (2013.01); *F25B 2600/0253* (2013.01)

(58) Field of Classification Search

CPC ..... F24F 12/00; F24F 12/001; F24F 12/003; F24F 13/30; F24F 7/06; F24F 2001/0037; F24F 2001/0062; F24F 2001/0066; F24F 2001/0096; F24F 2003/006; F24F 2003/003; F24F 2003/0048; F24F 3/525; F24F 3/0527; F25B 2313/025; F25B 2313/02523; F25B 2313/02531; F25B 2313/02532; F25B 2600/11; F25B 2600/0252; F25B 2600/0253;

(Continued)

(56) References Cited

U.S. PATENT DOCUMENTS

| | | | | |
|---|---|---|---|---|
| 3,638,857 A | | 2/1972 | Hogel et al. | |
| 4,257,238 A | * | 3/1981 | Kountz | F24F 11/0009 62/176.3 |
| 5,036,676 A | | 8/1991 | Dudley | |

(Continued)

OTHER PUBLICATIONS

Office Action dated Aug. 31, 2015; U.S. Appl. No. 14/167,955, filed Jan. 29, 2014; 18 pages.

(Continued)

*Primary Examiner* — Frantz F Jules
*Assistant Examiner* — Erik Mendoza-Wilkenfel
(74) *Attorney, Agent, or Firm* — Conley Rose, P.C.; J. Robert Brown, Jr.

(57) ABSTRACT

A heating, ventilation, and/or air conditioning (HVAC) system has a first variable refrigerant flow outdoor unit, a first ducted variable speed indoor unit configured to selectively exchange refrigerant with the first variable refrigerant flow outdoor unit, and a second indoor unit configured to selectively exchange refrigerant with the first variable refrigerant flow outdoor unit.

20 Claims, 8 Drawing Sheets

(58) Field of Classification Search
CPC .. F25B 49/022; F25B 49/025; F04B 2203/02; F04B 2203/0209
See application file for complete search history.

(56) References Cited

U.S. PATENT DOCUMENTS

| | | | | |
|---|---|---|---|---|
| 5,074,120 | A | 12/1991 | Kitamoto | |
| 5,203,179 | A | 4/1993 | Powell | |
| 5,396,779 | A | 3/1995 | Voss | |
| 5,673,570 | A * | 10/1997 | Sada | F04B 39/0207 62/193 |
| 5,692,385 | A | 12/1997 | Hollenbeck et al. | |
| 5,823,004 | A | 10/1998 | Polley et al. | |
| 9,625,184 | B2 | 4/2017 | Hu et al. | |
| 2002/0102936 | A1 | 8/2002 | Daumler | |
| 2005/0086954 | A1 | 4/2005 | Song et al. | |
| 2005/0257538 | A1 | 11/2005 | Hwang et al. | |
| 2005/0268628 | A1 | 12/2005 | Thompson | |
| 2006/0042277 | A1 | 3/2006 | Sadegh et al. | |
| 2006/0130504 | A1 * | 6/2006 | Agrawal | F25B 49/02 62/228.4 |
| 2009/0064697 | A1 | 3/2009 | Kondo et al. | |
| 2009/0071181 | A1 | 3/2009 | Spanger | |
| 2009/0229288 | A1 | 9/2009 | Alston et al. | |
| 2010/0024455 | A1 | 2/2010 | Butorac et al. | |
| 2010/0082162 | A1 * | 4/2010 | Mundy | F24F 3/044 700/277 |
| 2010/0107665 | A1 | 5/2010 | Kawano et al. | |
| 2012/0216989 | A1 | 8/2012 | Wakamoto et al. | |
| 2012/0303165 | A1 | 11/2012 | Qu et al. | |
| 2013/0104576 | A1 | 5/2013 | Lee | |
| 2017/0219255 | A1 | 8/2017 | Hu et al. | |

OTHER PUBLICATIONS

Final Office Action dated Feb. 19, 2016; U.S. Appl. No. 14/167,955, filed Jan. 29, 2014; 19 pages.
Advisory Action dated Mar. 24, 2016; U.S. Appl. No. 14/167,955, filed Jan. 29, 2014; 4 pages.
Office Action dated Apr. 14, 2016; U.S. Appl. No. 14/167,955, filed Jan. 29, 2014; 20 pages.
Final Office Action dated Sep. 28, 2016; U.S. Appl. No. 14/167,955, filed Jan. 29, 2014; 23 pages.
Notice of Allowance dated Dec. 9, 2016; U.S. Appl. No. 14/167,955, filed Jan. 29, 2014; 12 pages.
Office Action dated May 12, 2017; U.S. Appl. No. 15/486,811, filed Apr. 13, 2017; 24 pages.
Final Office Action dated Dec. 14, 2017; U.S. Appl. No. 15/486,811, filed Apr. 13, 2017; 36 pages.
Advisory Action dated Mar. 27, 2018; U.S. Appl. No. 15/486,811, filed Apr. 13, 2017; 3 pages.
Office Action dated Jun. 4, 2018; U.S. Appl. No. 15/486,811, filed Apr. 13, 2017; 36 pages.
Final Office Action dated Feb. 7, 2019; U.S. Appl. No. 15/486,811, filed Apr. 13, 2017; 39 pages.

* cited by examiner

MULTI-SPLIT HVAC SYSTEM

CROSS-REFERENCE TO RELATED APPLICATIONS

The present application is a continuation application of U.S. patent application Ser. No. 15/486,811 filed on Apr. 13, 2017 by Yi Hu, et al., entitled "Multi-Split HVAC System," which is a continuation of U.S. Pat. No. 9,625,184 issued on Apr. 18, 2017, entitled "Multi-Split HVAC System," which claims priority to U.S. Provisional Patent Application No. 61/759,279 filed on Jan. 31, 2013 by Yi Hu, et al., entitled "Multi-Split HVAC System," the disclosures of which are hereby incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some heating, ventilation, and/or air conditioning (HVAC) systems comprise a variable refrigerant flow (VRF), multi-speed, variable speed, and/or modulating compressor, condenser fan, and/or outdoor unit configured to selectively provide refrigerant flow to a plurality of cassette, wall, and/or ceiling type indoor units.

DETAILED DESCRIPTION

Figure 1:
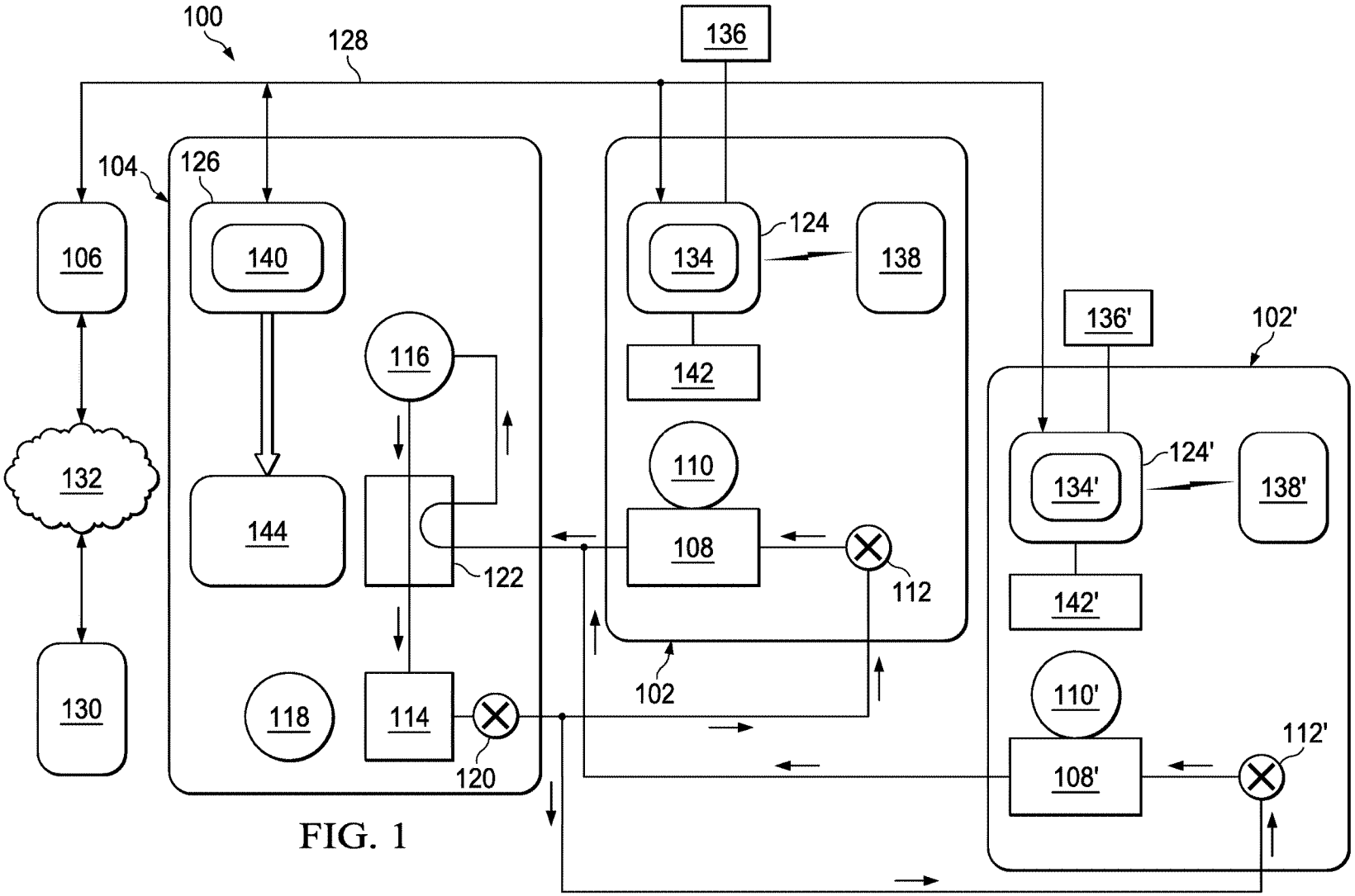
FIG. 1 is a schematic diagram of an HVAC system according to an embodiment of the disclosure.

Referring now to FIG. 1, a schematic diagram of an HVAC system 100 according to an embodiment of this disclosure is shown. HVAC system 100 comprises a first indoor unit 102, a second indoor unit 102' that is substantially similar to indoor unit 102, an outdoor unit 104, and a system controller 106. In some embodiments, the system controller 106 may operate to control operation of the indoor units 102,102' and/or the outdoor unit 104. As shown, the HVAC system 100 is a so-called heat pump system that may be selectively operated to implement one or more substantially closed thermodynamic refrigeration cycles to provide a cooling functionality and/or a heating functionality. The HVAC system 100 is also a multi-split system at least insofar as the indoor units 102,102' are both connected in selective fluid communication with the same outdoor unit 104 so that refrigerant may be selectively routed between the outdoor unit and each of the indoor units 102,102'. Because indoor unit 102' is substantially similar to indoor unit 102, the remainder of the description of the components of indoor unit 102 may similarly be present in indoor unit 102' but the components of and/or related to indoor unit 102' are not specifically discussed except to generally point out differences in operation between the components of indoor unit 102 and indoor unit 102'.

Indoor unit 102 comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In this embodiment, the communication bus 128 may connect the system controller 106 to each of the indoor controllers 124,124'. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or other device 130 via a communication network 132. In some embodiments, the communication network 132 may comprise a telephone network and the other device 130 may comprise a telephone. In some embodiments, the communication network 132 may comprise the Internet and the other device 130 may comprise a so-called smartphone and/or other Internet enabled mobile telecommunication device.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchangers 108,108' and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering devices 112,112' through and/or around the outdoor metering device 120 which does not substantially impede flow of the refrigerant in the cooling mode. The indoor metering devices 112,112' may meter passage of the refrigerant through the indoor metering device 112,112' so that the refrigerant downstream of the indoor metering devices 112,112' is at a lower pressure than the refrigerant upstream of the indoor metering device 112,112'. The pressure differential across the indoor metering devices 112,112' allows the refrigerant downstream of the indoor metering devices 112,112' to expand and/or at least partially convert to gaseous phase. The gaseous phase refrigerant may enter the indoor heat exchangers 108,108'. As the refrigerant is passed through the indoor exchangers 108,108', the indoor fans 110,110' may be operated to move air into contact with the indoor heat exchangers 108,108', thereby transferring heat to the refrigerant from the air surrounding the indoor heat exchangers 108,108'. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering devices 112,112' may be disabled and/or bypassed, and the outdoor metering device 120 may be enabled. In the heating mode, refrigerant may flow from the compressor 116 to the indoor heat exchangers 108,108' through the reversing valve 122, the refrigerant may be substantially unaffected by the indoor metering devices 112,112' the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchangers 108,108' and the outdoor heat exchanger 114 as compared to their operation in the cooling mode.

Figure 2:
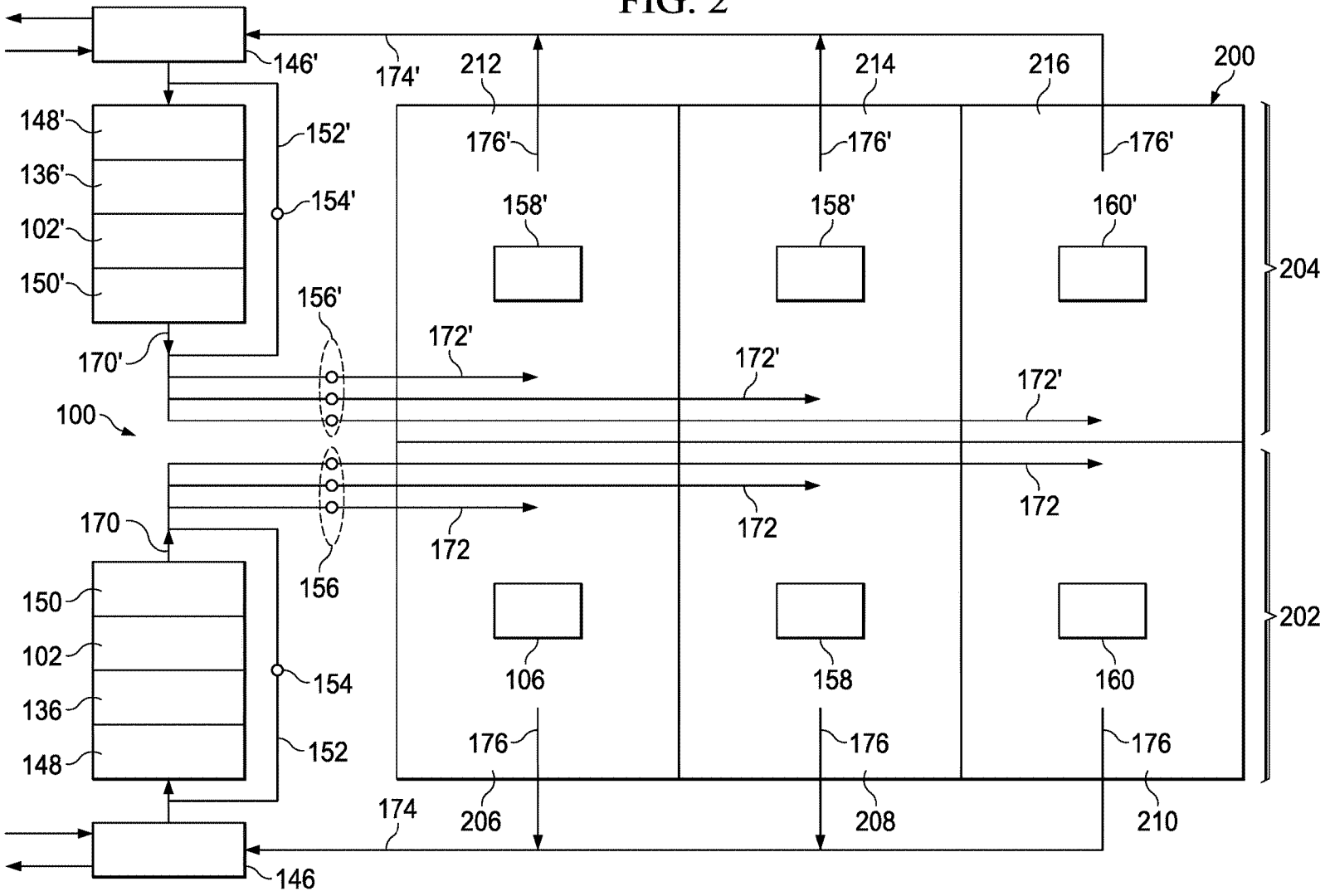
FIG. 2 is a simplified schematic diagram of the air circulation paths of the HVAC system of FIG. 1.

Referring now to FIG. 2, a schematic diagram of the air circulation paths for a structure 200 conditioned by HVAC system 100 is shown. In this embodiment, the structure 200 is conceptualized as comprising a lower floor 202 and an upper floor 204. The lower floor 202 comprises zones 206, 208, and 210 while the upper floor 204 comprises zones 212, 214, and 216. In this embodiment, the indoor unit 102 is associated with the lower floor 202 and is configured to circulate and/or condition air of lower zones 206, 208, and 210 while the indoor unit 102' is associated with the upper floor 204 and is configured to circulate and/or condition air of upper zones 212, 214, and 216. In this embodiment, each of the indoor units 102,102' are configured as ducted air handling units (AHUs). The indoor unit 102 is connected to a supply air plenum 170 that feeds a plurality of supply air ducts 172. The indoor unit 102 is connected to a return air plenum 174 that receives air from a plurality of return air ducts 176. Similarly, the indoor unit 102' is connected to a supply air plenum 170' that feeds a plurality of supply air ducts 172'. Further, the indoor unit 102' is connected to a return air plenum 174' that receives air from a plurality of return air ducts 176'.

In addition to the components of HVAC system 100 described above, in this embodiment, the HVAC system 100 further comprises ventilators 146, 146', prefilters 148,148', humidifiers 150,150', and bypass ducts 152,152'. The ventilators 146,146' may be operated to selectively exhaust circulating air to the environment and/or introduce environmental air into the circulating air. The prefilters 148,148' may generally comprise a filter media selected to catch and/or retain relatively large particulate matter prior to air exiting the prefilters 148,148' and entering the air cleaners 136,136'. The humidifiers 150,150' may be operated to adjust a humidity of the circulating air. The bypass ducts 152,152' may be utilized to regulate air pressures within the ducts that form the circulating air flow paths. In some embodiments, air flow through the bypass ducts 152,152' may be regulated by a bypass dampers 154,154' while air flow delivered to the zones 206, 208, 210, 212, 214, and 216 may be regulated by zone dampers 156,156'.

Still further, the HVAC system 100 may comprise zone thermostats 158,158' and zone sensors 160,160'. In some embodiments, zone thermostats 158,158' may communicate with the system controller 106 and may allow a user to control a temperature, humidity, and/or other environmental setting for the zone in which the zone thermostats 158,158' is located. Further, the zone thermostats 158,158' may communicate with the system controller 106 to provide temperature, humidity, and/or other environmental feedback regarding the zone in which the zone thermostats 158,158' are located. In some embodiments, the zone sensors 160, 160' may communicate with the system controller 106 to provide temperature, humidity, and/or other environmental feedback regarding the zone in which the zone sensors 160,160' are located.

While HVAC system 100 is shown as a so-called split system comprising indoor units 102,102' located separately from the outdoor unit 104, alternative embodiments of an HVAC system 100 may comprise a so-called package system in which one or more of the components of the indoor units 102,102' and one or more of the components of the outdoor unit 104 are carried together in a common housing or package. The HVAC system 100 is shown as a so-called ducted system where the indoor unit 102 is located remote from the conditioned zones, thereby requiring air ducts to route the circulating air. However, in alternative embodiments, an HVAC system 100 may be configured so that one of the indoor units 102,102' comprise a non-ducted system in which the non-ducted indoor unit does not requiring air ducts to route the air conditioned by the non-ducted indoor unit.

In some embodiments, an additional system controller substantially to system controller 106 may be associated with indoor unit 102' and the additional system controller may be configured for bidirectional communication with the system controller 106 so that a user may, using any of the system controllers, monitor and/or control any of the HVAC system 100 components regardless of which zones the components may be associated. Further, each system controller 106, each zone thermostat 158,158', and each zone sensor 160,160' may comprise a humidity sensor. As such, it will be appreciated that structure 200 is equipped with a plurality of humidity sensors in a plurality of different locations. In some embodiments, a user may effectively select which of the plurality of humidity sensors is used to control operation of the HVAC systems 100.

Figure 3:
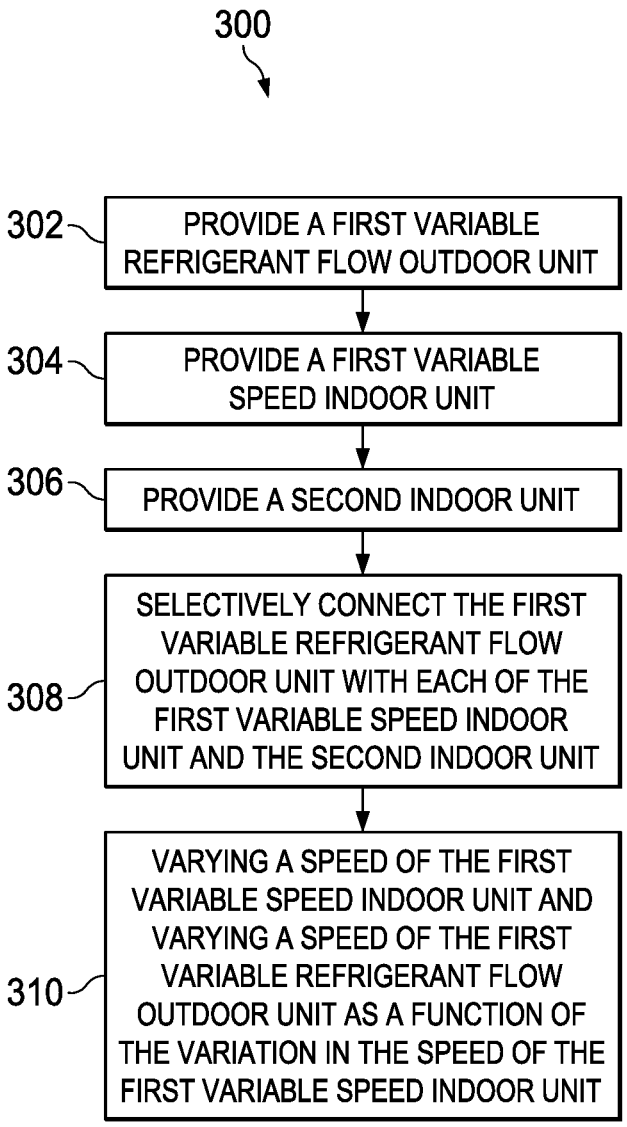
FIG. 3 is a flowchart of a method of operating an HVAC system according to an embodiment of the disclosure.

Referring now to FIG. 3, a flowchart of a method 300 of operating an HVAC system is shown according to an embodiment of the disclosure. In some embodiments, an HVAC system such as HVAC system 100 may be operated according to the method 300. The method 300 may begin at block 302 by providing a first variable refrigerant flow outdoor unit such as outdoor unit 104. The method 300 may continue at block 304 by providing a first variable speed indoor unit such as indoor unit 102. The method 300 may continue at block 306 by providing a second indoor unit such as indoor unit 102'. The method 300 may continue at block 308 by selectively connecting the first variable refrigerant flow outdoor unit with each of the first variable speed indoor unit and the second indoor unit. In some cases, the method 300 may continue at block 310 by varying a speed of the first variable speed indoor unit and varying a speed of the first variable refrigerant flow outdoor unit as a function of the variation in speed of the first variable speed indoor unit. In alternative embodiments, a speed of the variable speed indoor unit may be varied as function of a variation in a speed of the variable refrigerant flow outdoor unit. Alternatively, speeds of the variable refrigerant flow outdoor unit and the variable speed indoor unit may be controlled relatively independently and/or simultaneously to maintain a desired capacity and/or capacity ratio. For example, in some embodiments, a system controller such as system controller 106 may determine a heating, cooling, humidification, and/or ventilation demand of one or multiple indoor units and thereafter control a speed of each variable speed component in an attempt to satisfy the determined demand.

Figure 4:
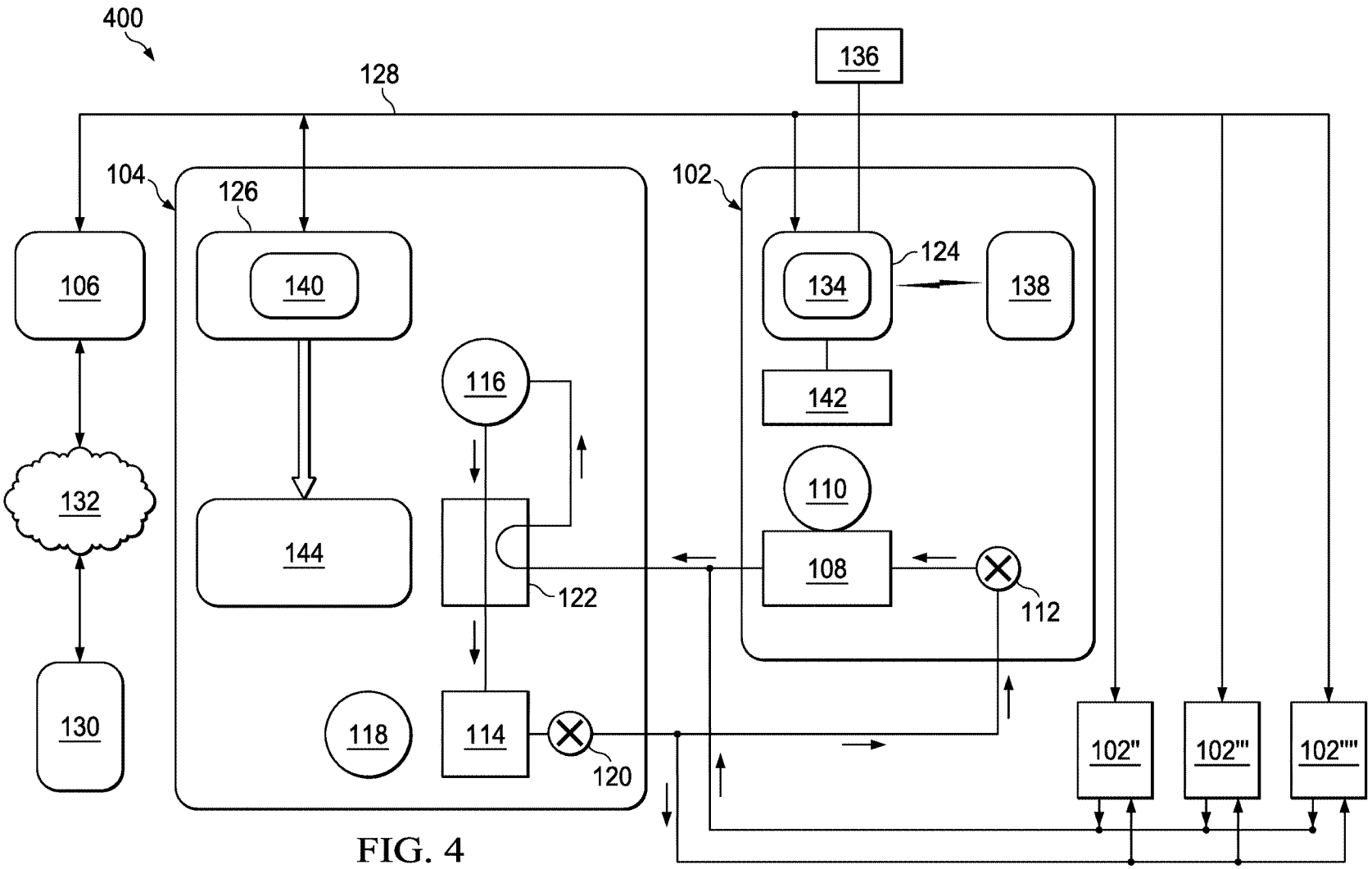
FIG. 4 is a schematic diagram of an HVAC system according to another embodiment of the disclosure.
Figure 5:
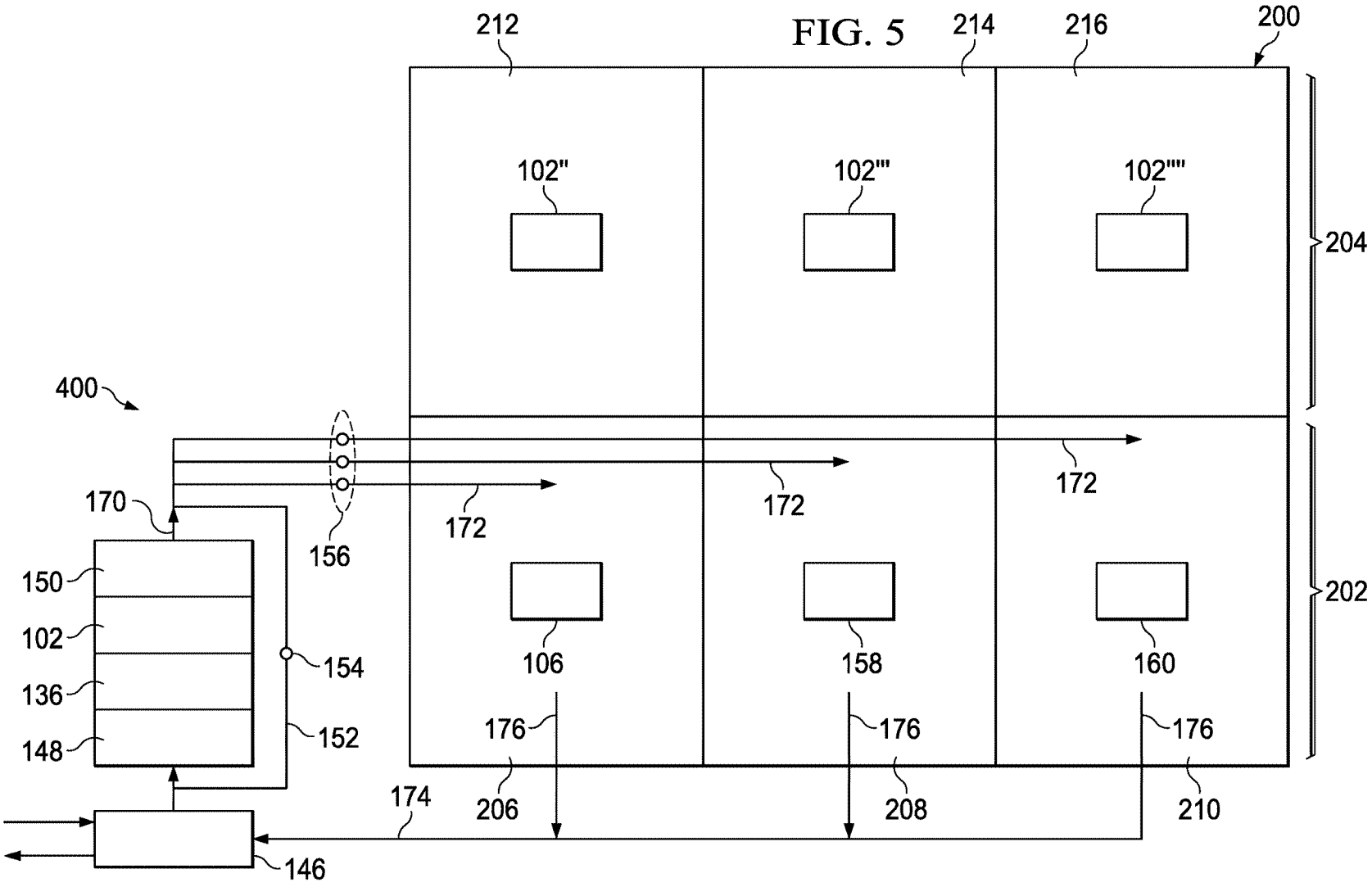
FIG. 5 is a simplified schematic diagram of the air circulation paths of the HVAC system of FIG. 4.

Referring now to FIGS. 4 and 5, a schematic diagram of an HVAC system 400 according to an embodiment of this disclosure and a schematic diagram of the air circulation paths for a structure 200 conditioned by HVAC system 400 are shown. The HVAC system 400 is substantially similar to HVAC system 100 but rather than comprising two ducted variable speed indoor units such as ducted variable speed indoor units 102,102', the HVAC system 400 comprises a ducted variable speed indoor unit 102 and a plurality of non-ducted variable speed indoor units 102",102''',102''''. Each of the non-ducted variable speed indoor units 102", 102''',102'''' comprise at least a heat exchanger such as indoor heat exchanger 108 and an associated indoor metering device such as indoor metering device 112. The non-ducted variable speed indoor units 102",102''',102'''' may comprise cartridge, wall mounted, and/or ceiling mounted components that are located local to the zones 212, 214, 216 that they condition, respectively. In other words, the non-ducted variable speed indoor units 102",102''',102'''' comprise no supply air plenums, supply air ducts, return air plenums, and/or return air ducts such as supply air plenums 170, supply air ducts 172, return air plenums 174, and/or return air ducts 176, respectively.

Figure 6:
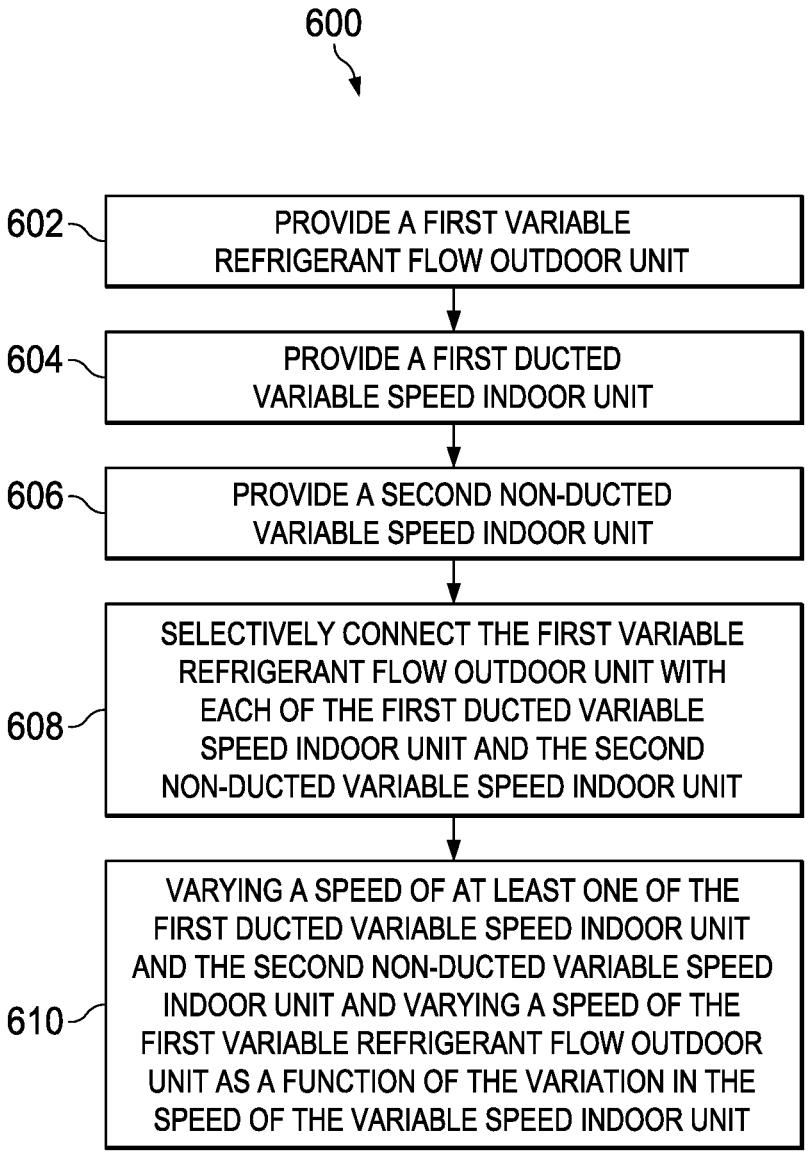
FIG. 6 is a flowchart of a method of operating an HVAC system according to another embodiment of the disclosure.

Referring now to FIG. 6, a flowchart of a method 600 of operating an HVAC system is shown according to an embodiment of the disclosure. In some embodiments, an HVAC system such as HVAC system 400 may be operated according to the method 600. The method 600 may begin at block 602 by providing a first variable refrigerant flow outdoor unit such as outdoor unit 104. The method 600 may continue at block 604 by providing a first ducted variable speed indoor unit such as ducted indoor unit 102. The method 600 may continue at block 606 by providing a second non-ducted variable speed indoor unit such as non-ducted variable speed indoor unit 102". The method 600 may continue at block 608 by selectively connecting the first variable refrigerant flow outdoor unit with each of the first ducted variable speed indoor unit and the second non-ducted variable speed indoor unit. In some cases, the method 600 may continue at block 610 by varying a speed of the first ducted variable speed indoor unit and varying a speed of the first variable refrigerant flow outdoor unit as a function of the variation in speed of the first ducted variable speed indoor unit. In alternative embodiments, a speed of the first ducted variable speed indoor unit may be varied as function of a variation in a speed of the variable refrigerant flow outdoor unit. Alternatively, speeds of the variable refrigerant flow outdoor unit and the first ducted variable speed indoor unit may be controlled relatively independently and/or simultaneously to maintain a desired capacity and/or capacity ratio. For example, in some embodiments, a system controller such as system controller 106 may determine a heating, cooling, humidification, and/or ventilation demand of one or multiple indoor units and thereafter control a speed of each variable speed component in an attempt to satisfy the determined demand.

Figure 7:
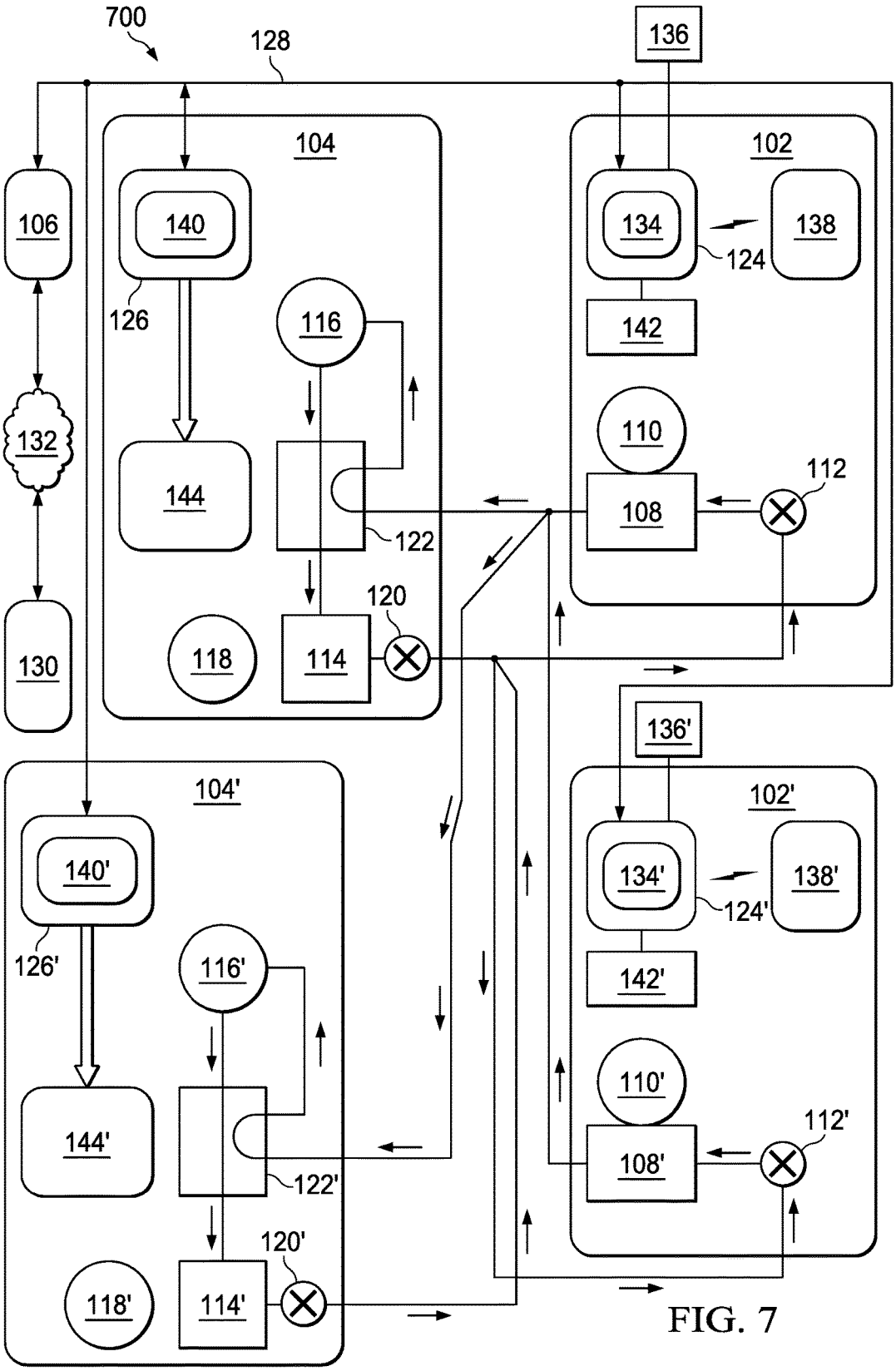
FIG. 7 is a schematic diagram of an HVAC system according to another embodiment of the disclosure.

Referring now to FIG. 7, a schematic diagram of an HVAC system 700 according to an embodiment of this disclosure is shown. The HVAC system 700 is substantially similar to HVAC system 100 but rather than comprising one variable refrigerant flow outdoor unit such as variable refrigerant flow outdoor unit 104, the HVAC system 700 additionally comprises a second variable refrigerant flow outdoor unit 104' that is substantially similar to the variable refrigerant flow outdoor unit 104. In some embodiments, the second variable refrigerant flow outdoor unit 104' is joined in fluid communication with the refrigerant circuit of outdoor unit 104 and is controlled similarly so that the second variable refrigerant flow outdoor unit 104' and the first variable refrigerant flow outdoor unit 104 may cooperate to pump refrigerant through the refrigerant circuits collectively between the outdoor units 104,104' and the indoor units 102,102'.

Figure 8:
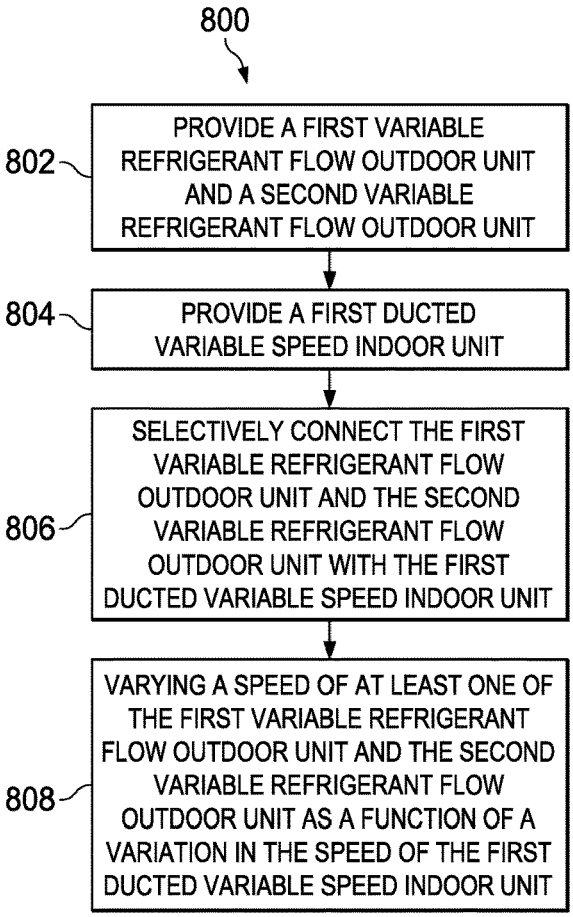
FIG. 8 is a flowchart of a method of operating an HVAC system according to another embodiment of the disclosure.

Referring now to FIG. 8, a flowchart of a method 800 of operating an HVAC system is shown according to an embodiment of the disclosure. In some embodiments, an HVAC system such as HVAC system 700 may be operated according to the method 800. The method 800 may begin at block 802 by providing a first variable refrigerant flow outdoor unit such as outdoor unit 104 and providing a second variable refrigerant flow outdoor unit such as outdoor unit 104'. The method 800 may continue at block 804 by providing a first ducted variable speed indoor unit such as ducted indoor unit 102. The method 800 may continue at block 808 by varying a speed of at least one of the first variable refrigerant flow outdoor unit and the second variable refrigerant flow outdoor unit as a function of a variation in speed of the first ducted variable speed indoor unit. In alternative embodiments, a speed of at least one of the first variable refrigerant flow outdoor unit and the second variable refrigerant flow outdoor may be controlled relatively independently and/or simultaneously with the first ducted variable speed indoor unit to maintain a desired capacity and/or capacity ratio. For example, in some embodiments, a system controller such as system controller 106 may determine a heating, cooling, humidification, and/or ventilation demand of one or multiple indoor units and thereafter control a speed of at least one of the first variable refrigerant flow outdoor unit and the second variable refrigerant flow outdoor unit in an attempt to satisfy the determined demand.

This disclosure contemplates that any number and/or combination of indoor unit types (whether traditional vertical/horizontal ducted, non-ducted, cassette, wall, and/or ceiling type) may be connected to one or more variable refrigerant flow outdoor units (whether traditional full size/capacity or smaller capacity capable of overdrive operation). In some embodiments, an HVAC system of the type disclosed herein may extend ductless and variable refrigerant flow product applications to a much broader market by using horizontal/vertical air handlers and/or furnaces. In some embodiments, an HVAC system of the type disclosed herein may serve to replace multiple HVAC systems, such as for large home or light commercial buildings, thereby saving installation cost and equipment. In some embodiments, an HVAC system of the type disclosed herein may comprise back-up heat. In some embodiments, an HVAC system of the type disclosed herein may address a limitation of ductless products, namely, the problems of having no backup heat for use during low ambient environment conditions and/or poor air distribution as a function of inadequately sized air movement equipment of the ductless systems. In some embodiments, an HVAC system of the type disclosed herein may improve an energy efficiency rating or EER for a ductless product, thereby potentially helping the HVAC system to qualify for E-star ratings, regional standards compliance, government incentives, and/or rebates. Still further, in some embodiments, additional refrigeration connections may be provided between indoor and outdoor units to allow a heat recovery functionality that repurposes heat that was extracted during cooling mode operation of at least one indoor unit and rather than emitting the heat to the atmosphere via an outdoor unit, reuses the heat by directing the heat to at least one of heat exchangers associated with a zone that needs heat, ventilation air that needs heat, water heaters that need heat, air curtains that need heat, and/or other applications that could utilize the heat.

Figure 9:
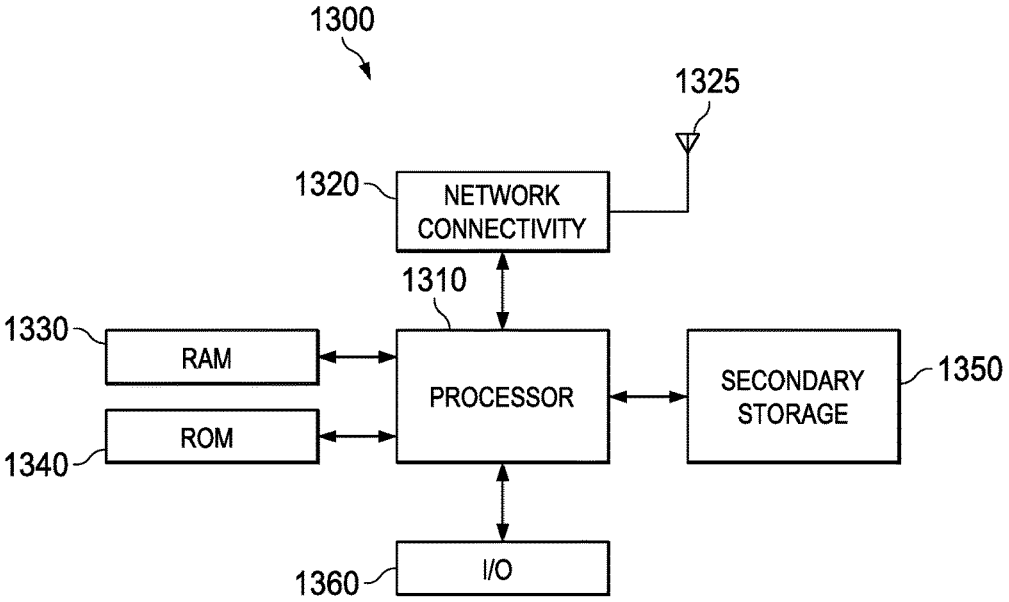
FIG. 9 is a simplified representation of a general-purpose processor (e.g. electronic controller or computer) system suitable for implementing the embodiments of the disclosure.

FIG. 9 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system comprising:

a variable refrigerant flow outdoor unit;

a first variable speed indoor unit configured to selectively exchange refrigerant with the first variable refrigerant flow outdoor unit;

a second variable speed indoor unit configured to selectively exchange refrigerant with the variable refrigerant flow outdoor unit; and a system controller configured to vary a speed of the first variable speed indoor unit, the second variable speed indoor unit, and the variable refrigerant flow outdoor unit, wherein the speed of the first variable speed indoor unit and the speed of the variable refrigerant flow outdoor unit are a function of a variation in speed of the second variable speed indoor unit.

2. The HVAC system of claim 1, wherein the first variable speed indoor unit and the second variable speed indoor unit are ducted units.

3. The HVAC system of claim 1, wherein the first variable speed indoor unit is a ducted unit and the second variable speed indoor unit is a non-ducted unit.

4. The HVAC system of claim 1, wherein the system controller is further configured to vary the speed of the variable refrigerant flow outdoor unit as a function of the variation in speed of the first variable speed indoor unit.

5. The HVAC system of claim 1, wherein the first variable speed indoor unit is a ducted unit, wherein the system controller is further configured to vary the speed of the variable refrigerant flow outdoor unit as a function of the variation in speed of the first variable speed indoor unit.

6. The HVAC system of claim 1, wherein the second variable speed indoor unit is a non-ducted unit, wherein the system controller is further configured to vary the speed of the variable refrigerant flow outdoor unit as a function of the variation in speed of the second variable speed indoor unit.

7. The HVAC system of claim 1, wherein the system controller is further configured to determine a heating, cooling, humidification, and/or ventilation demand of each of the first and second variable speed indoor units and thereafter control a speed of the first and second variable speed indoor units to satisfy a determined demand.

8. A heating, ventilation, and/or air conditioning (HVAC) system comprising:

a variable refrigerant flow outdoor unit;

a first variable speed indoor unit configured to selectively exchange refrigerant with the first variable refrigerant flow outdoor unit;

a second variable speed indoor unit configured to selectively exchange refrigerant with the variable refrigerant flow outdoor unit; and a system controller configured to vary a speed of the first variable speed indoor unit, the second variable speed indoor unit, and the variable refrigerant flow outdoor unit, wherein the speed of the first variable speed indoor unit, the speed of the second variable speed indoor unit, and the speed of the variable refrigerant flow outdoor unit are controlled independently and/or simultaneously to maintain a desired capacity and/or capacity ratio;

wherein the speed of the first variable speed indoor unit and the speed of the variable refrigerant flow outdoor unit are a function of a variation in sped of the second variable speed indoor unit.

9. The HVAC system of claim 8, wherein the system controller is further configured to determine a heating, cooling, humidification, and/or ventilation demand of at least one of the first variable speed indoor unit and the second variable speed indoor unit, and thereafter control the speed of each of the first variable speed indoor and the second variable speed indoor unit in an attempt to satisfy a determined demand.

10. The HVAC system of claim 8, wherein the speed of the first variable speed indoor unit is varied as a function of a variation in the speed of the variable refrigerant flow outdoor unit.

11. The HVAC system of claim 8, wherein the first variable speed indoor unit and the second variable speed indoor unit are ducted units.

12. The HVAC system of claim 8, wherein the first variable speed indoor unit is a ducted unit and the second variable speed indoor unit is a non-ducted unit.

13. A method of operating a heating, ventilation, and/or air conditioning (HVAC) system, the method comprising:

providing a variable refrigerant flow outdoor unit;

providing a first variable speed indoor unit;

providing a second variable speed indoor unit;

operating the first and second variable speed indoor units to selectively exchange refrigerant with the variable refrigerant flow outdoor unit;

providing a system controller; and varying, with the system controller, a speed of the first variable speed indoor unit and a speed of the variable refrigerant flow outdoor unit as a function of a variation in speed of the second variable speed indoor unit.

14. The method of claim 13, wherein the first variable speed indoor unit and the second variable speed indoor unit are ducted units.

15. The method of claim 13, wherein the first variable speed indoor unit is a ducted unit and the second variable speed indoor unit is a non-ducted unit.

16. The method of claim 13, further comprising determining a heating, cooling, humidification, and/or ventilation demand of each of the first and second variable speed indoor units.

17. The method of claim 16, further comprising controlling the speeds of the first and second variable speed indoor units to satisfy a determined demand.

18. The method of claim 13, further comprising controlling independently the speed of the first variable speed indoor unit, the second variable speed indoor unit, and the variable refrigerant flow outdoor unit.

19. The method of claim 13, further comprising controlling simultaneously the speed of the first variable speed indoor unit, the second variable speed indoor unit, and the variable refrigerant flow outdoor unit.

20. The method of claim 13, further comprising controlling the speed of the first variable speed indoor unit, the second variable speed indoor unit, and the variable refrigerant flow outdoor unit in response to a demand for at least one of heating and cooling in a zone conditioned by at least one of the first variable speed indoor unit and the second variable speed indoor unit.

* * * * *